US011692474B2

(12) United States Patent
Vaginet

(10) Patent No.: US 11,692,474 B2
(45) Date of Patent: Jul. 4, 2023

(54) COOLING CIRCUIT FOR A MOTOR VEHICLE

(71) Applicant: ILLINOIS TOOL WORKS INC., Glenview, IL (US)

(72) Inventor: Dominique Vaginet, St. Bernard (FR)

(73) Assignee: ILLINOIS TOOL WORKS INC., Glenview, IL (US)

( * ) Notice: Subject to any disclaimer, the term of this patent is extended or adjusted under 35 U.S.C. 154(b) by 28 days.

(21) Appl. No.: 17/433,299

(22) PCT Filed: Feb. 27, 2020

(86) PCT No.: PCT/US2020/020039
§ 371 (c)(1),
(2) Date: Aug. 24, 2021

(87) PCT Pub. No.: WO2020/180589
PCT Pub. Date: Sep. 10, 2020

(65) Prior Publication Data

US 2022/0136428 A1 May 5, 2022

(30) Foreign Application Priority Data

Mar. 4, 2019 (FR) ..... 1902189

(51) Int. Cl.
*F01P 7/14* (2006.01)
*F01P 5/12* (2006.01)

(52) U.S. Cl.
CPC ..... *F01P 7/14* (2013.01); *F01P 5/12* (2013.01); *F01P 2007/146* (2013.01)

(58) Field of Classification Search
CPC ..... F01P 7/14; F01P 2007/146
See application file for complete search history.

(56) References Cited

U.S. PATENT DOCUMENTS 3,457,949 A 7/1969 Coulter
3,873,239 A * 3/1975 Jamieson ..... F04C 28/24 417/295

(Continued)

FOREIGN PATENT DOCUMENTS

EP 1621805 A1 2/2006

OTHER PUBLICATIONS

PCT, International Search Report and Written Opinion, International Application No. PCT/US2020/020039; dated May 20, 2020, 9 pages.

*Primary Examiner* — Long T Tran
(74) *Attorney, Agent, or Firm* — Thompson Hine LLP

(57) ABSTRACT

A cooling circuit for a vehicle includes at least one pump (10) and a plurality of branches (12, 14) for circulation of a cooling fluid. At least one branch (12) includes a flow rate limiter (24) with a valve (28), the flow rate limiter including a body (26) in which is mounted a valve (28) mobile between a first position in which it delimits a first fluid passage section (S2) at the outlet of the limiter and a second position in which it delimits a second fluid passage section (S3) in the limiter, the second section being smaller than the first section. The valve is biased into its first position and configured to be moved from the first position to the second position when the fluid flow rate at the inlet of the limiter exceeds a predetermined threshold.

9 Claims, 7 Drawing Sheets

(56) References Cited

U.S. PATENT DOCUMENTS

| | | | | |
|---|---|---|---|---|
| 4,410,133 | A * | 10/1983 | Furukubo | G05D 23/1366 236/100 |
| 5,409,042 | A * | 4/1995 | Kirchner | G05D 7/012 138/40 |
| 5,904,177 | A * | 5/1999 | Mullin | G05D 7/0133 137/503 |
| 8,336,849 | B2 * | 12/2012 | Farner | F16K 1/123 251/30.01 |
| 2004/0216701 | A1 * | 11/2004 | Hutchins | G05D 23/1333 123/41.08 |
| 2005/0097880 | A1 * | 5/2005 | Jansen | F02M 37/18 60/39.281 |
| 2009/0000600 | A1 * | 1/2009 | Sullivan | F02M 37/0023 123/510 |
| 2016/0001650 | A1 | 1/2016 | Wright | |
| 2017/0009894 | A1 * | 1/2017 | Seko | F16K 31/041 |
| 2019/0195118 | A1 * | 6/2019 | Iida | F01N 3/043 |

* cited by examiner

COOLING CIRCUIT FOR A MOTOR VEHICLE

TECHNICAL FIELD OF THE INVENTION

The invention concerns the field of cooling circuits for vehicles, in particular motor vehicles.

TECHNICAL BACKGROUND

A cooling circuit of a motor vehicle, such as that represented in FIG. 1, conventionally comprises at least one pump 10 for circulating a cooling fluid, such as water, in the circuit, which is a closed circuit. At the outlet of the pump 10 the circuit comprises a plurality of branches 12, 14 including a branch 12 that feeds a device 16 for heating the passenger compartment of the vehicle and a branch 14 that feeds an engine block 18 of the vehicle in order to cool it. The circuit may naturally comprise more branches each comprising a cooling device (EGR valve, etc.) and the trend is to more and more complex cooling circuits with a great number of branches connected in parallel to the outlet of the pump.

Each device has its own requirements in terms of cooling. The EGR valve for example requires to be cooled strongly at low engine speeds and cooled to the same level at high engine speeds. The engine block 18 requires cooling proportional to the engine speed.

The pump 10 of the circuit is generally a mechanical pump that delivers a fluid flow rate proportional to the engine speed, which is perfect for cooling the engine block 18 but creates a high loss of energy in the case of cooling other devices such as the EGR valve because at high engine speeds the cooling fluid flow rate will be much greater than that required.

This problem is well known in the current state of the art and it becomes crucial to solve it in a simple, effective and economic manner given the present attempts to reduce the fuel consumption of vehicles. Solutions that would for example consist in equipping the circuit with controlled valves enabling adaptation of the fluid feed flow rates of the various devices as a function of their requirement at each engine speed are too complex and costly to use.

SUMMARY OF THE INVENTION

The invention concerns a cooling circuit of for vehicle, in particular a motor vehicle, said circuit including at least one pump and a plurality of branches for circulation of a cooling fluid, characterized in that at least one branch includes a flow rate limiter with a valve, said flow rate limiter including a body in which is mounted a valve mobile between a free first position in which it delimits a first fluid passage section at the outlet of the limiter and a second position in which it delimits a second fluid passage section at the outlet of the limiter, the second section being smaller than the first section, and the valve being biased into its first position and configured to be moved from the first position to the second position when the fluid flow rate at the inlet of the limiter exceeds a predetermined threshold.

The invention therefore proposes a simple and reliable solution for adjusting the fluid flow rates in the branches of a cooling circuit. The flow rate limiters and the circuit function autonomously in that each flow rate limiter adjusts the flow rate in the branch in which it is installed as a function of the feed flow rate of that branch and therefore of the engine speed of the vehicle. Thus the limiters are not controlled. The movement of the valve of each limiter from its first position to its second position and vice-versa may be progressive.

The circuit may comprise one or more of the following features, separately from one another or combined with one another:

the flow rate limiter includes a compression spring that biases the valve into its first position, said spring having a compression force chosen as a function of said threshold, the spring is a coil spring, the body has a tubular general shape and comprises coaxial tubular sections of which a first section has a diameter D1 and defines an internal housing to receive the valve and of which a second section has a diameter D2, less than D1, and defines an internal housing to receive the spring, the first and second sections are disposed between a third section forming a fluid inlet of the body and a fourth section forming a fluid outlet of said body, the valve is independent of said body, the valve takes the form of a cylindrical pin one longitudinal end of which is an ogive-shaped head, the pin comprises longitudinal guide ribs sliding in said body, the longitudinal ribs are extended axially beyond the longitudinal ends of the pin to form abutments adapted to cooperate with annular shoulders inside said body, at least two branches each include a flow rate limiter, said flow rate limiters having different predetermined thresholds for movement of their valves, the pump is configured to be actuated by an engine block of the vehicle, the valve is formed in one piece.

BRIEF DESCRIPTION OF THE FIGURES

Other features and advantages of the invention will become apparent upon reading the following detailed description, to understand which see the appended drawings, in which.

DETAILED DESCRIPTION OF THE INVENTION

Figure 1:
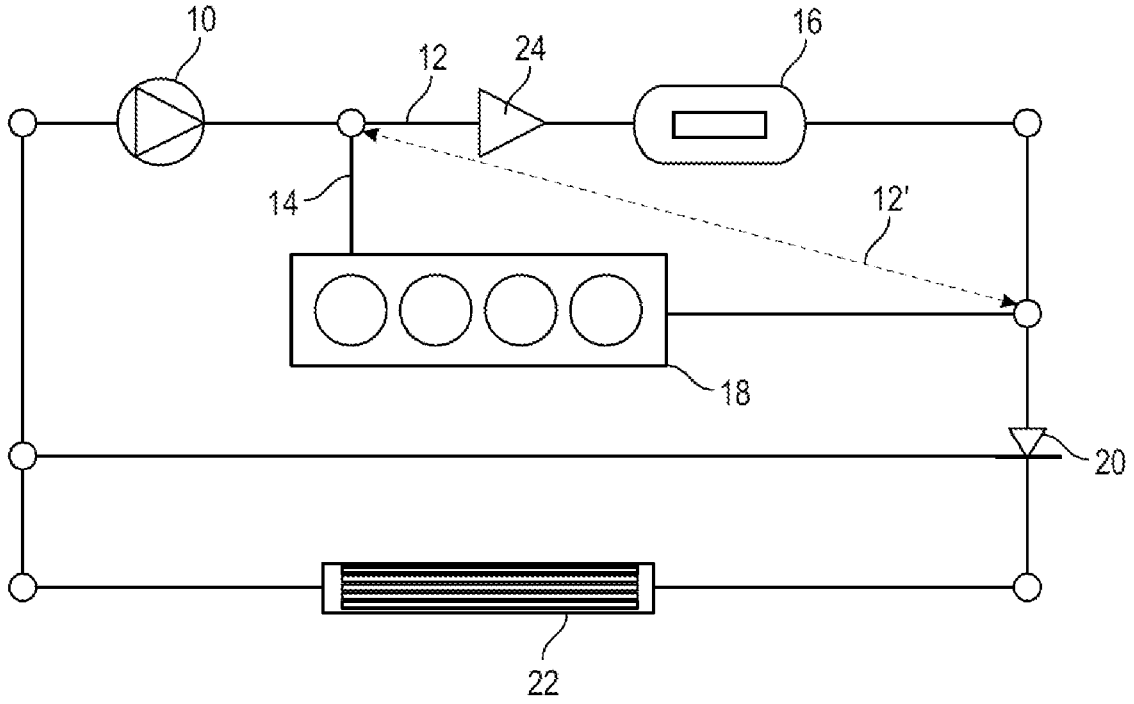
FIG. 1 is a highly diagrammatic view of a cooling circuit of a vehicle.
Figure 2:
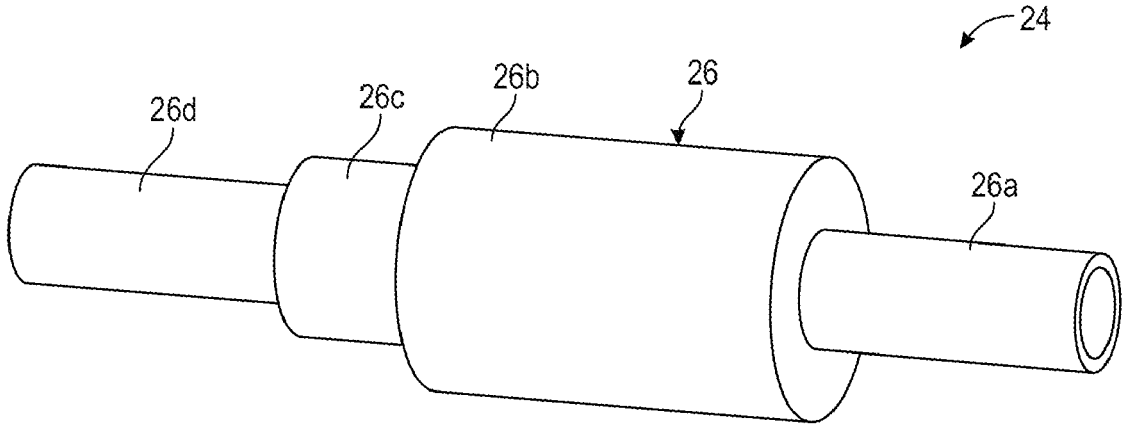
FIG. 2 is a diagrammatic perspective view of a flow rate limiter according to one embodiment of the invention.

As mentioned above, FIG. 1 shows a cooling circuit for a motor vehicle, which is a closed circuit and comprises at least one pump 10 for circulating a cooling fluid, such as water, in a plurality of branches 12, 14.

The branches 12, 14 extend in parallel between the outlet of the pump 10 and a thermostat 20. The thermostat 20 is connected to the inlet of the pump 10 by a direct pipe and by a parallel pipe including a radiator 22.

The branch 12 feeds a device 16 for heating the passenger compartment of the vehicle and the branch 14 feeds an engine block 18 of the vehicle in order to cool it. The circuit may naturally comprise more branches.

The cooling fluid feed flow rate of the engine block 18 is of the order of 120 L/min and depends on the engine speed. At high engine speeds the flow rate increases and at low engine speeds the flow rate decreases. The flow rate of the cooling fluid is therefore a function of the engine speed, which is highly appropriate because the engine block 18 has a cooling requirement proportional to the engine speed.

The branch 12 has for example a cooling fluid flow rate requirement of the order of 40 L/min. This requirement may be considered constant and does not need to be adjusted up and down as a function of the engine speed.

The invention enables this requirement to be addressed by means of a flow rate limiter 24 mounted on the branch 12. The flow rate limiter 24 is of the valve type and comprises a mobile (movable) valve to adjust the fluid passage section and therefore the fluid flow rate at the outlet of the limiter as a function of the flow rate at the inlet of said limiter. The valve is configured to be moved when the fluid flow rate at the inlet of the limiter exceeds a predetermined threshold. Below that threshold the valve is not moved and defines a given passage section at the outlet of the limiter. Starting at and beyond said threshold the valve is moved and adopts a position in which it defines a smaller passage section at the outlet of the limiter, in order for the outlet fluid flow rate to be reduced.

FIGS. 2 to 7 show one embodiment of a flow rate limiter 24.

The limiter 24 essentially comprises a body 26 in which is mounted a mobile valve 28.

Figure 5:
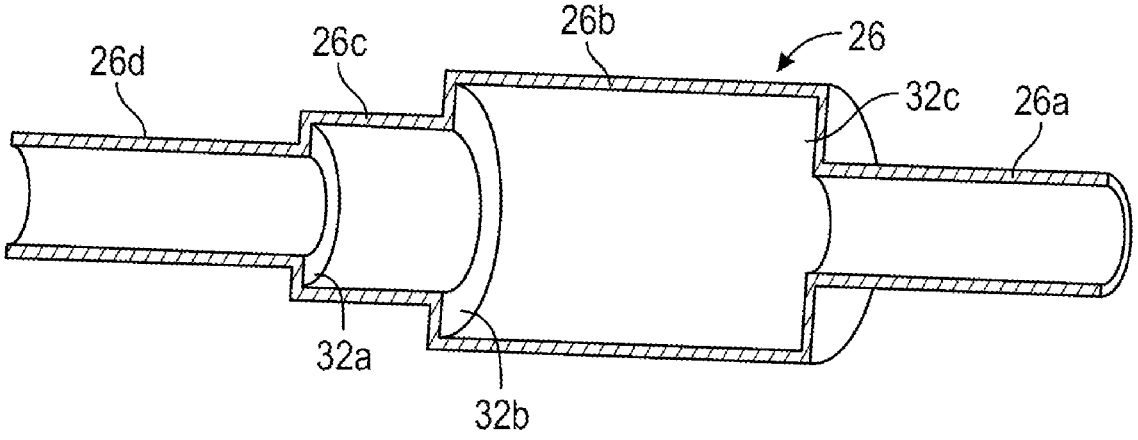
FIG. 5 is a diagrammatic axial sectional view of the body of the flow rate limiter from FIG. 2.

In the example shown, the body 26, shown separately in FIG. 5, has a tubular general shape and comprises a plurality of coaxial sections 26*a*-26*d*. The body 26 comprises at one longitudinal end a fluid inlet section 26*a* and at its opposite longitudinal end a fluid outlet section 26*d*. Between the sections 26*a*, 26*d* the body comprises two other sections 26*b*, 26*c* having different diameters D1, D2 greater than those of the sections 26*a*, 26*d*.

The section 26*b* with the greater diameter D1 defines a housing to receive the valve 28. The valve 28 is mobile axially in this section between a first position shown in FIG. 3 and a second position shown in FIG. 4.

The section 26*c* with the smaller diameter D2 defines a housing to receive a member for biasing the valve 28 into its first position. In the example shown said member is a compression spring 30 which is in a relaxed position in FIG. 3 and compressed in FIG. 4. Here the compression spring is a coil spring.

The section 26*c* is connected to the section 26*d* by an annular shoulder 32*a* and to the section 26*b* by another annular shoulder 32*b* (FIG. 5). Moreover, the section 26*b* is connected to the section 26*a* by another annular shoulder 32*c* (FIG. 5).

The spring 30 bears at one end on the shoulder 32*a* and at its opposite end on the valve 28. The valve 28 is mobile in the section 26*b* and cooperates with the shoulders 32*b*, 32*c* to define end of travel positions of the valve in the body 26.

Figure 6:
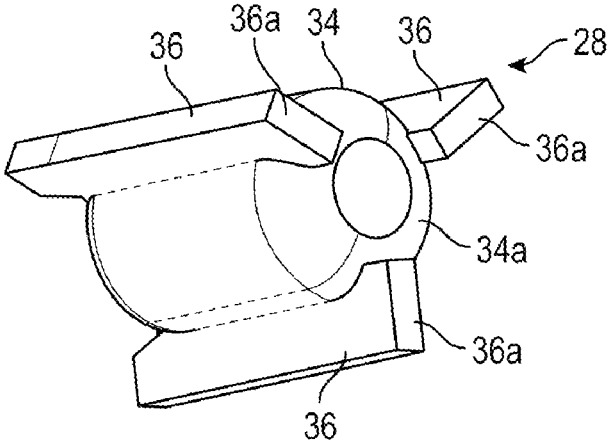
FIG. 6 is a diagrammatic perspective view of the valve of the flow rate limiter from FIG. 2.
Figure 7:
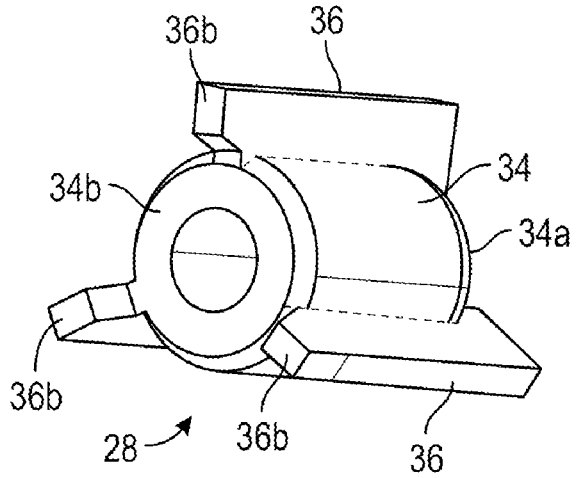
FIG. 7 is another diagrammatic perspective view of the valve of the flow rate limiter from FIG. 2.

The valve 28 can be seen better in FIGS. 6 and 7 and comprises a pin 34 of cylindrical general shape one longitudinal end of which is conformed as an ogive-shaped head 34*a*. At its opposite longitudinal end the pin 34 comprises an annular surface 34*b* on which the spring 30 bears.

The valve 28 further comprises longitudinal ribs 36 to guide it when it slides in the body. Here there are three ribs 36 and they are regularly spaced around the lengthwise axis of the pin 34. They are configured to slide on and therefore to cooperate with the cylindrical internal surface of the section 26*b* extending between the shoulders 32*b*, 32*c*.

The ribs 36 are extended axially beyond the longitudinal ends of the pin 34 to form abutments or abutment surfaces 36*a*, 36*b* adapted to cooperate with the shoulders 32*b*, 32*c*. The abutments 36*a* are situated at the same end as the ogive-shaped head 34*a* and are adapted to bear on the shoulder 32*c* to define an end of travel position shown in FIG. 3. The abutments 36*b* are situated at the opposite end of the pin 34 and are adapted to bear on the shoulder 32*b* to define an end of travel position shown in FIG. 4.

Figure 3:
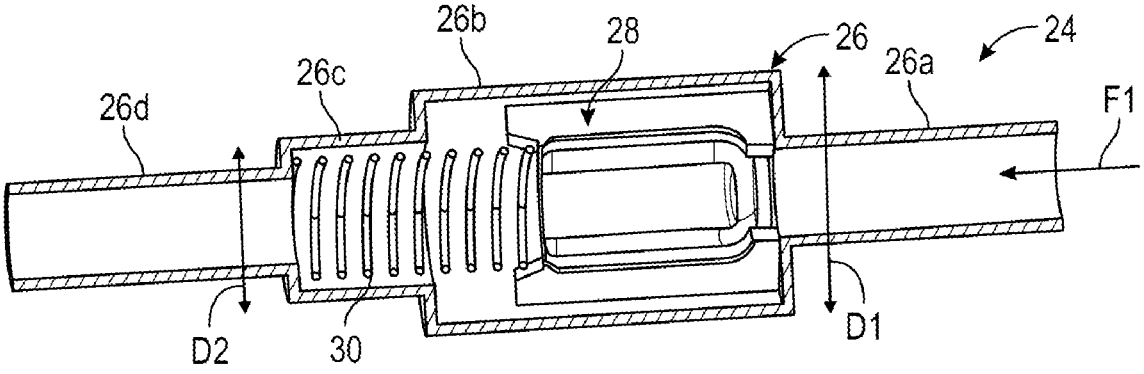
FIG. 3 is a diagrammatic axial sectional view of the flow rate limiter from FIG. 2, its valve being in a first position.

FIG. 3 shows the position of the valve 28 when the spring 30 is in the free or relaxed state. The spring remains in this position as long as the inlet fluid flow rate of the limiter 24 and of the body 26 (arrow F1) is below a predetermined threshold, for example 40 L/min. The abutments 36*a* bear on the shoulder 32*c* and define between them three fluid passage sectors between the ogive-shaped head 34*a* of the pin and the section 26*a*. These passage sectors define a passage section denoted S1 (which is not shown in the drawings) at the inlet of the limiter 24. At the outlet of the limiter the valve does not significantly obstruct the passage section, which may be denoted S2 (not shown).

Figure 4:
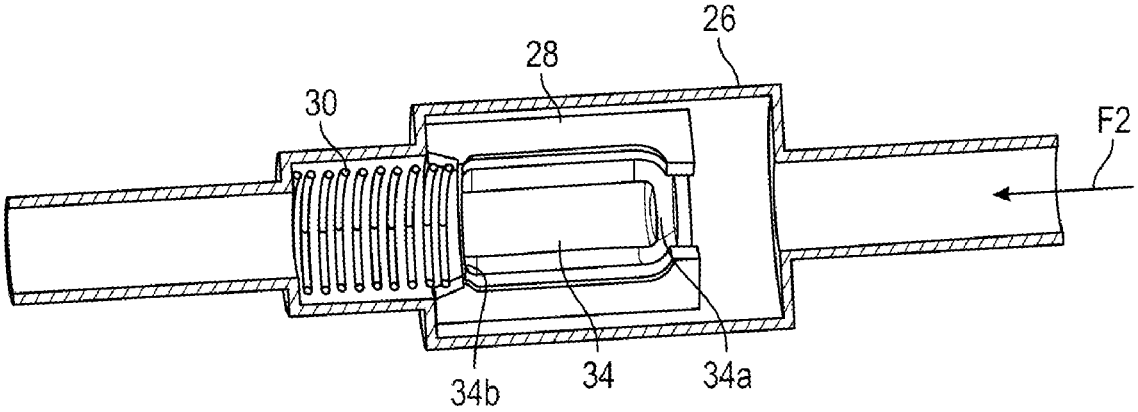
FIG. 4 is a diagrammatic axial sectional view of the flow rate limiter from FIG. 2, its valve being in a second position.

FIG. 4 shows the position of the valve 28 when the spring 30 is compressed. The spring adopts this position when the inlet fluid flow rate of the limiter and of the body (arrow F2) is above or at the aforementioned threshold. The fluid bears on the valve 28 and in particular on the ogive-shaped head 34*a* and moves it in the body 26. It is therefore clear that the compression force of the spring is chosen as a function of the threshold (the compression force of the spring can be selected to provide a desired threshold), said force being 10 N for example in one particular embodiment of the invention. The abutments 36*b* bear on the shoulder 32*b* and define between them three fluid passage sectors between the surface 34*b* of the pin and the section 26*c*. These passage sectors define a passage section denoted S3 (which is not shown). S3 is less than the passage section S2 at the outlet of the limiter 24 when the valve 28 is in the FIG. 3 position. The limiter 24 therefore enables reduction of the fluid flow rate in the branch 12 to just what is required to feed the devices in that branch.

The cooling circuit may comprise a flow rate limiter 24 on one branch 12 and advantageously comprise a flow rate limiter on a plurality of branches 12, 12'. In the latter case, the flow rate limiters may have different predetermined valve movement thresholds.

The invention claimed is:

1. A cooling circuit for a vehicle, said cooling circuit including at least one pump and a plurality of branches for circulation of a cooling fluid, wherein at least one branch includes a flow rate limiter with an inlet, an outlet and a valve, said flow rate limiter including a body in which the valve is mounted for movement between a first position in which the valve delimits a first fluid passage section at the outlet of the limiter and a second position in which the valve delimits a second fluid passage section at the outlet of the limiter, the second fluid passage section being smaller than the first fluid passage section, and the valve being biased into the first position and configured to be moved from the first position to the second position when the fluid flow rate at the inlet of the limiter exceeds a predetermined threshold;

wherein the valve comprises an elongate pin slidable in said body, the pin having first and second longitudinal ends, wherein a plurality of longitudinal ribs are arranged on an outer surface of the pin, wherein the longitudinal ribs extend axially beyond the first longitudinal end and the second longitudinal end to form first abutments beyond the first longitudinal end and second abutments beyond the second longitudinal end, wherein the second fluid passage section is defined by engagement of the second abutments with an annular shoulder at the outlet when the valve is in the second position.

2. The cooling circuit according to claim 1, in which the flow rate limiter includes a compression spring that biases the valve into the first position, said compression spring having a compression force chosen as a function of said predetermined threshold.

3. The cooling circuit according to claim 2, in which the compression spring is a coil spring.

4. The cooling circuit according to claim 2, in which the body has a tubular shape and comprises coaxial tubular sections of which a first section has a diameter D1 and defines an internal housing to receive the valve and of which a second section has a diameter D2, less than D1, and defines an internal housing to receive the compression spring.

5. The cooling circuit according to claim 1, in which the valve is independent of said body.

6. The cooling circuit according to claim 1, wherein the pin is cylindrical and the first longitudinal end is formed by an ogive-shaped head.

7. The cooling circuit according to claim 1, wherein the first abutments engage with a further annular shoulder at the inlet when the valve is in the first position.

8. The cooling circuit according to claim 1, in which at least two branches each include a flow rate limiter, said flow rate limiters having different predetermined thresholds for movement of their respective valves.

9. A cooling circuit for a vehicle, said cooling circuit including at least one pump and a plurality of branches for circulation of a cooling fluid, wherein at least one branch includes a flow rate limiter with an inlet, an outlet and a valve, said flow rate limiter including a body in which the valve is mounted for movement between a first position in which the valve delimits a first fluid passage section at the outlet of the limiter and a second position in which the valve delimits a second fluid passage section at the outlet of the limiter, the second fluid passage section being smaller than the first fluid passage section, and the valve being biased into the first position and configured to be moved from the first position to the second position when the fluid flow rate at the inlet of the limiter exceeds a predetermined threshold;

wherein the valve comprises an elongate pin slidable in said body, the pin having first and second longitudinal ends, wherein a plurality of abutments extend from the pin beyond the second longitudinal end, wherein the second fluid passage section is defined by engagement of the abutments with an annular shoulder at the outlet when the valve is in the second position, wherein the annular shoulder faces toward the inlet.

* * * * *